US005088128A

United States Patent [19]

Kape

[11] Patent Number: 5,088,128

[45] Date of Patent: Feb. 18, 1992

[54] DROP DOWN CUFF ARRANGEMENT FOR PANT LEGS OR SLEEVES

[76] Inventor: Sandy N. Kape, 405 Charlotte St., Punta Gorda, Fla. 33950

[21] Appl. No.: 680,411

[22] Filed: Apr. 4, 1991

Related U.S. Application Data

[63] Continuation of Ser. No. 446,314, Dec. 5, 1989, abandoned.

[51] Int. Cl.[5] ..... A41D 27/10

[52] U.S. Cl. ..... 2/269; 2/227; 2/243 R; 2/79

[58] Field of Search ..... 2/269, 227, 243 R, 79

[56] References Cited

U.S. PATENT DOCUMENTS

| | | | |
|---|---|---|---|
| 147,059 | 7/1909 | Messick | 2/269 |
| 811,662 | 2/1906 | Puryear | 2/269 |
| 1,761,886 | 6/1930 | Haspel | 2/269 |
| 1,921,467 | 8/1933 | Hymes | 2/269 |
| 2,214,120 | 9/1940 | Connor | 2/269 |
| 2,328,137 | 8/1943 | Goldberg | 2/269 |
| 2,338,552 | 1/1944 | Stephenson | 2/269 |
| 2,524,814 | 10/1950 | Leaf | 2/269 |
| 2,535,224 | 12/1950 | Nachem | 2/269 |
| 2,677,829 | 5/1954 | Rothstein et al. | 2/269 |
| 2,713,685 | 7/1955 | Nachem | 2/243 |
| 2,883,674 | 4/1959 | Stein | 2/269 |
| 3,060,446 | 10/1962 | Horne | 2/73 |
| 3,166,765 | 1/1965 | Getchell | 2/227 |
| 3,170,167 | 2/1965 | Isaacs | 2/269 |
| 3,328,809 | 7/1967 | Payne et al. | 2/269 |
| 3,435,463 | 4/1969 | Jay | 2/269 |
| 3,538,513 | 11/1970 | Hernandez | 2/269 |
| 3,722,001 | 3/1973 | Bailey | 2/269 |
| 4,149,275 | 4/1979 | Sanchez | 2/269 |
| 4,200,938 | 5/1980 | LeTourneau | 2/269 |
| 4,259,751 | 4/1981 | Drmaj | 2/269 |
| 4,602,389 | 7/1986 | Brown | 2/243 R |
| 4,631,753 | 12/1986 | Ehring | 2/85 |
| 4,697,288 | 10/1987 | Palumbo | 2/269 |
| 4,896,379 | 1/1990 | Kape | 2/269 |

FOREIGN PATENT DOCUMENTS

| | | | |
|---|---|---|---|
| 643886 | 7/1962 | Canada | 2/269 |
| 471550 | 6/1969 | Switzerland | 2/269 |

*Primary Examiner*—Werner H. Schroeder
*Assistant Examiner*—Gloria Hale
*Attorney, Agent, or Firm*—Frank A. Lukasik

[57] ABSTRACT

A drop down cuff arrangement for pant legs or sleeves provides for lowering of a child's pant legs or sleeves and a cuff to cover the old seam so that it is no longer visible. The drop down cuff arrangement comprises a pant leg or sleeve having a high position wherein a first portion of the leg or sleeve includes a finished hem at the end to form a high position hemline, a cuff strip stitched to the outside of the leg or sleeve above the high position hemline, folded upwards away from the high position hemline, and held in place to the outside of the leg or sleeve by a removable attachment system and the pant leg or sleeve having a low position wherein the cuff strip is released from the removable attachment system and folded down over the high position hemline. In a second embodiment, the cuff strip is not held in place in the high position by a removable attachment system but by stiffening the cuff by way of patterned stitching applied thereon.

3 Claims, 4 Drawing Sheets

10
22
18
12
24
14

10
12
14
18
22
24

10
22
2
2
18
24
14

10
22
12
24
14

10
22
26
12
24
14

8
10
22
8
24
26
14
25

DROP DOWN CUFF ARRANGEMENT FOR PANT LEGS OR SLEEVES

RELATED PATENT APPLICATION

This application is a continuation of application Ser. No. 07/446,314, Filed Dec. 5, 1989, now abandoned.

The present invention relates to a cuff on a pant leg or sleeve of a jacket. More specifically, the present invention provides a drop down cuff arrangement for pant legs or sleeves.

BACKGROUND OF THE INVENTION

During a child's growth, the legs and arms tend to grow at a faster rate than the child's girth. Thus, whereas trousers or jackets may fit a child's waist or chest, the pant legs or arm sleeves are the first part of the garment that appear too small. In some cases, cuffs on pant legs can be lowered, and sleeves lengthened, however, in the majority of cases, clothes are not made to be lengthened as there is insufficient material available to lower a hem either on pant legs or on jacket sleeves.

Various attempts have been made to provide garments with legs or sleeves having adjustable lengths. One example is Canadian Patent 643,886 which issued July 3, 1962. However, in most cases the garments require a lot of material to be either rolled up or formed into a bulky cuff at the bottom of the leg or sleeve which is inconvenient. Furthermore, when the cuff is lowered, there is always a worn hemline visible. Such a hemline can become frayed and thus the pant legs show this frayed hemline when lowered.

I have found that by making a drop down cuff arrangement according to my invention, I can provide a cuff that folds down over a hemline of the pant leg or sleeve, thus hiding the hemline so that it cannot be seen as a worn or frayed hemline. Thus, legs of a pair of pants or sleeves of a jacket can have the hemline lowered without the original hemline being visible.

SUMMARY OF THE INVENTION

According to one broad aspect of the present invention, there is provided a drop down cuff arrangement for a pant leg, sleeve or the like comprising: a pant leg or sleeve having a high position wherein a first portion of the leg or sleeve includes a finished hem at the end to form a high position hemline; a cuff strip stitched to the outside of the leg or sleeve above the high position hemline, folded upwards away from the high position hemline, and held in place to the outside of the leg or sleeve by a removable attachment means; and the pant leg or sleeve having a low position wherein the cuff strip is released from the removable attachment means and folded down over the high position hemline. In a preferred embodiment, the removable attachment means are VELCRO pads.

According to a second broad aspect of the invention, there is provided a drop down cuff arrangement for a pant leg, sleeve or the like comprising: a pant leg or sleeve having a high position wherein a first portion of the leg or sleeve includes a finished hem at the end to form a high position hemline; a cuff strip stitched to the outside of the leg or sleeve above the high position hemline, folded upwards away from the high position hemline, said cuff strip being held in place by stiffening means therefor; the pant leg or sleeve having a low position wherein the cuff strip is folded down over the high position hemline. In a preferred embodiment, the said stiffening means for the cuff strip consists of patterned stitching being applied thereon to thereby stiffen the cuff strip.

DESCRIPTION OF THE PREFERRED EMBODIMENT OF THE INVENTION

Figures 1, 2, 3:
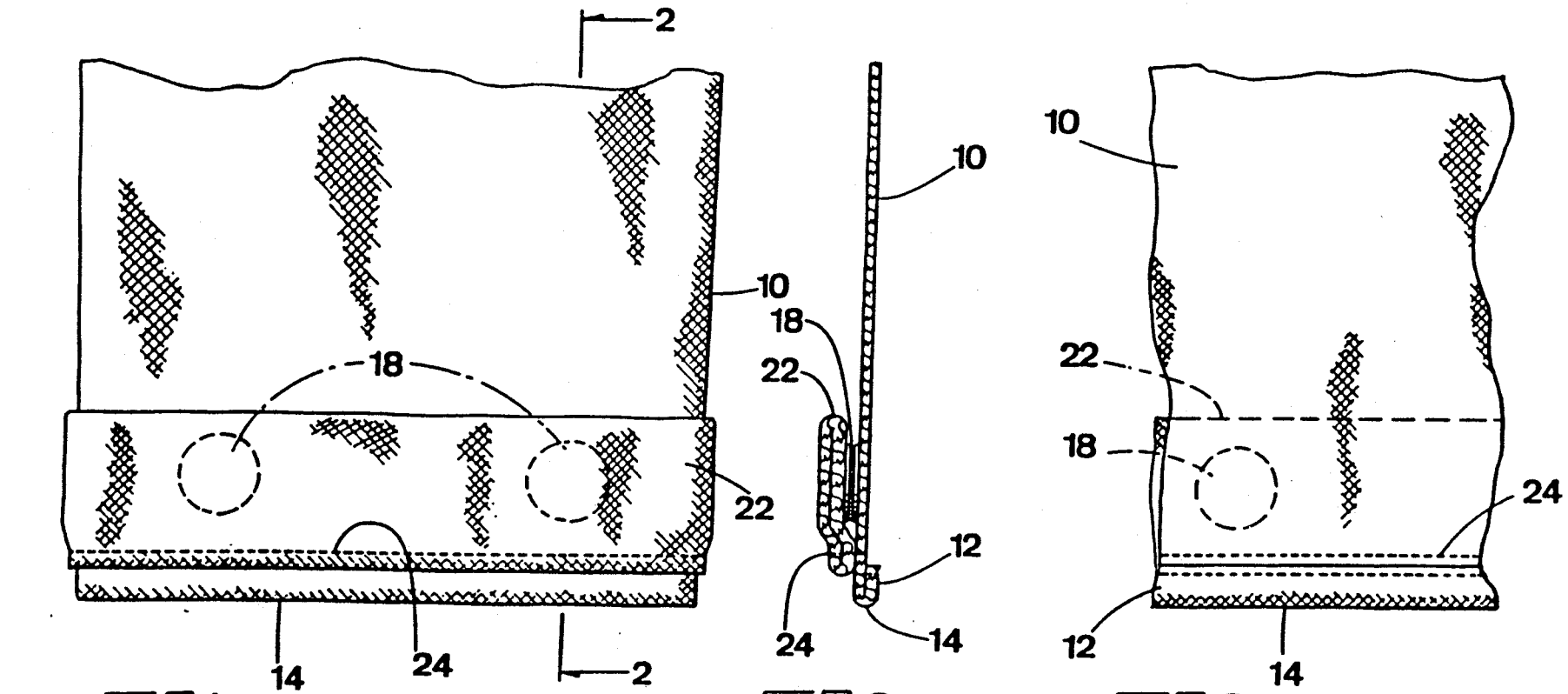
FIG. 1 is an outside view of a pant leg with a drop down cuff arrangement according to one embodiment of the present invention in the high position.
FIG. 2 is a cross section taken through one side of a pant leg shown in FIG. 1.
FIG. 3 is an inside view of the pant leg shown in FIG. 1.

Referring now to the drawings, the pant leg 10 or sleeve according to a first embodiment of the invention is provided with a high position hemline as shown in FIGS. 1 through 3. The pant leg 10 has a turned in hem 12 to provide a high position hemline 14. Two VELCRO pads 18 as shown in FIGS. 1 and 2 are attached to the outside surface of the leg 10 above the high position hemline 14.

A cuff 22, which is a tubular construction, is attached to the outside of the leg 10 by a cuff stitch 24 at the base of the cuff 22. Two opposed pairs of VELCRO pads 18, as shown in FIGS. 1 and 2, are attached to the outside surface of the leg 10 above the high position hemline 14 and on the inside surface of the cuff 22. In the high position as shown in FIGS. 1, 2, and 3, the cuff 22 is held to the pant leg by the two opposed pairs of VELCRO pads 18 which are hidden under the cuff 22 when it is in the high position.

Figure 6:
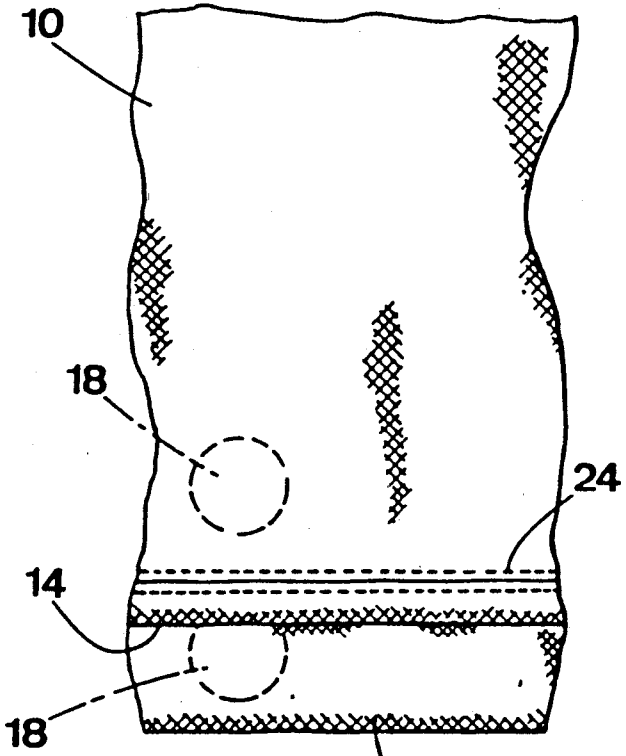
FIG. 6 is an inside view of the pant leg shown in FIG. 4.
Figure 5:
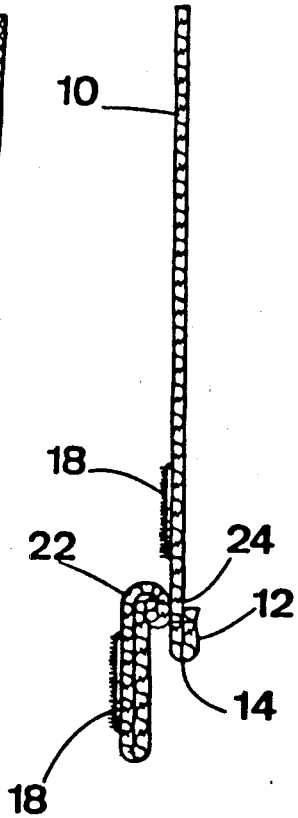
FIG. 5 is a cross section taken through one side of a pant leg shown in FIG. 4.
Figure 4:
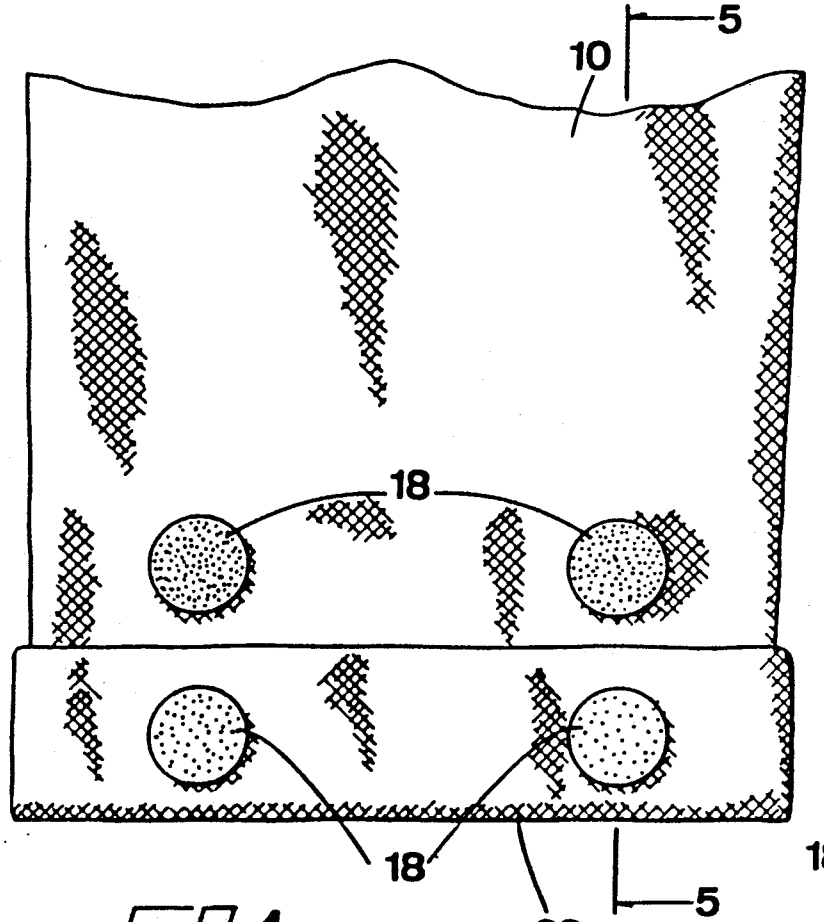
FIG. 4 is an outside view of the cuff arrangement shown in FIG. 1 in the low position.

When it is desired to lower the pant leg 10 from the high position to the low position, the cuff strip is released by separating the two opposed pairs of VELCRO pads 18 and by folding the cuff down to the low position as shown in FIGS. 4, 5, and 6. The cuff strip 22 in the low position then hides the high position hemline 14. In the low position, the two separated pairs of VELCRO pads 18 are visible both above the cuff strip 22 and on the lowered cuff strip itself, but apart from these two exposed parts of pads, there will be no indication that the pant legs or sleeves have been lowered.

Whereas VELCRO pads have been illustrated herein, it will be apparent to those skilled in the art that other attachment means may be provided other than VELCRO pads such as buttons, hooks and eyes, etc. The VELCRO pads are shown as a circle, however, they could be strips. Whereas a pant leg is illustrated, the drop down cuff would apply equally well to a sleeve of a jacket or the like.

Figures 7, 8, 9:
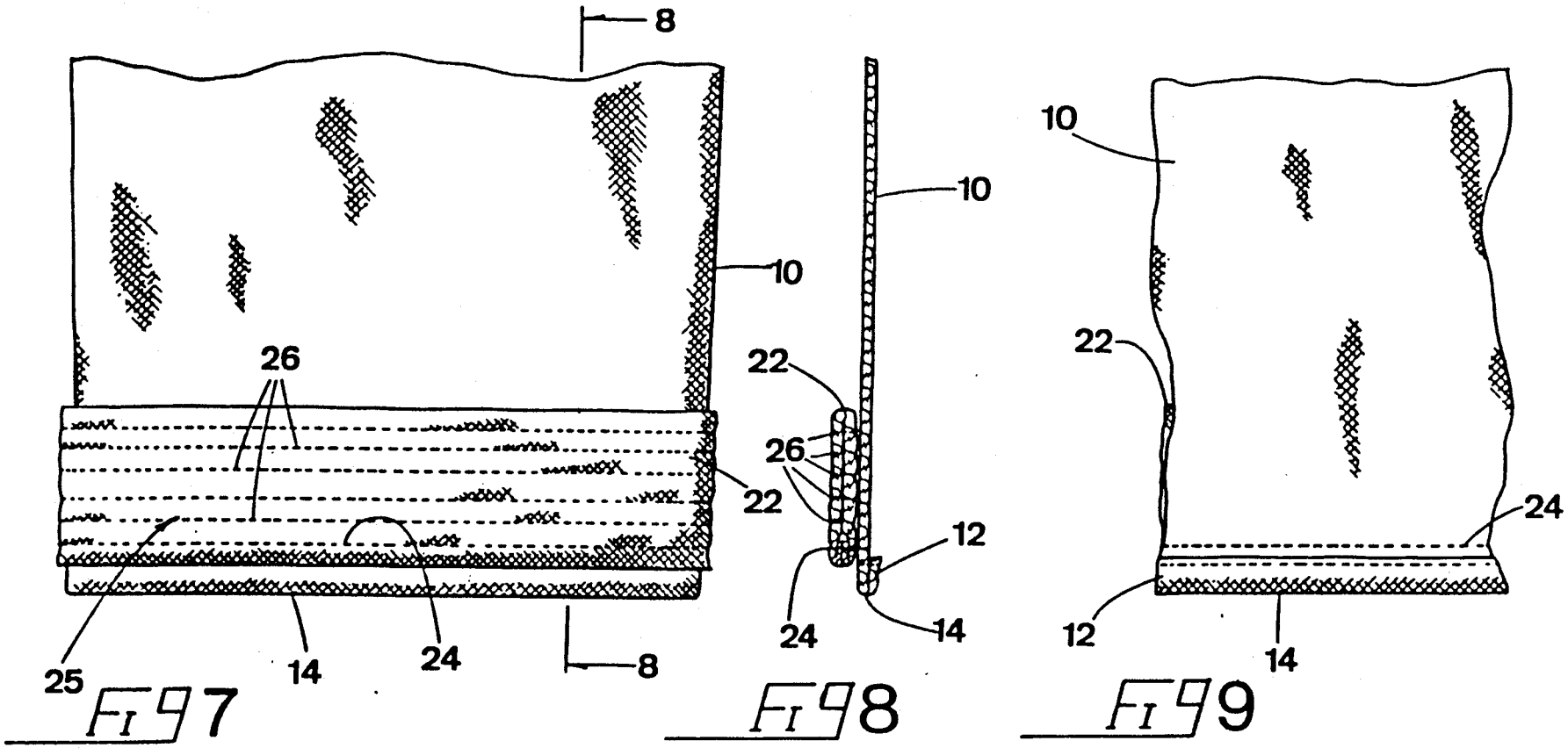
FIG. 7 is an outside view of a pant leg with a drop down cuff arrangement according to a second embodiment of the present invention in the high position.
FIG. 8 is a cross section taken through one side of a pant leg shown in FIG. 7.
FIG. 9 is an inside view of the pant leg shown in FIG. 7.
Figure 12:
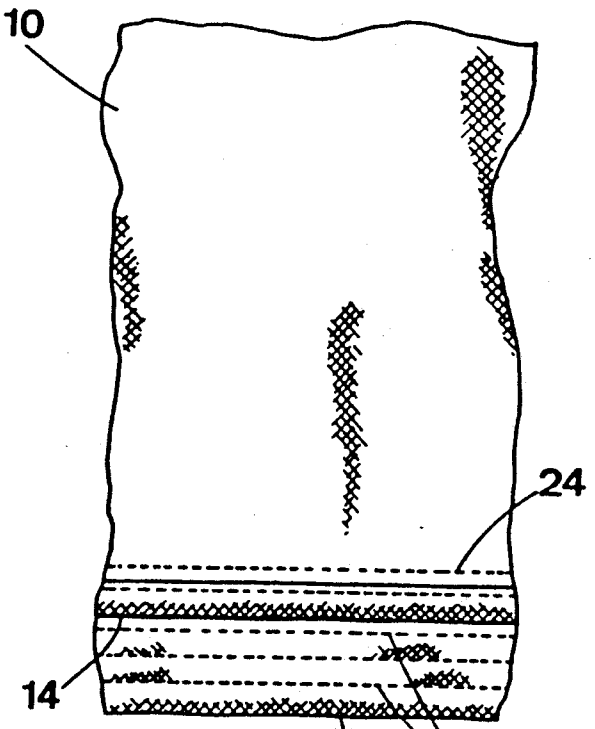
FIG. 12 is an inside view of the pant leg shown in FIG. 10.
Figure 11:
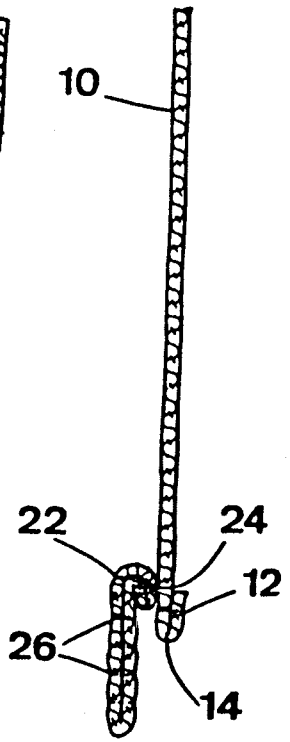
FIG. 11 is a cross section taken through one side of a pant leg shown in FIG. 10.
Figure 10:
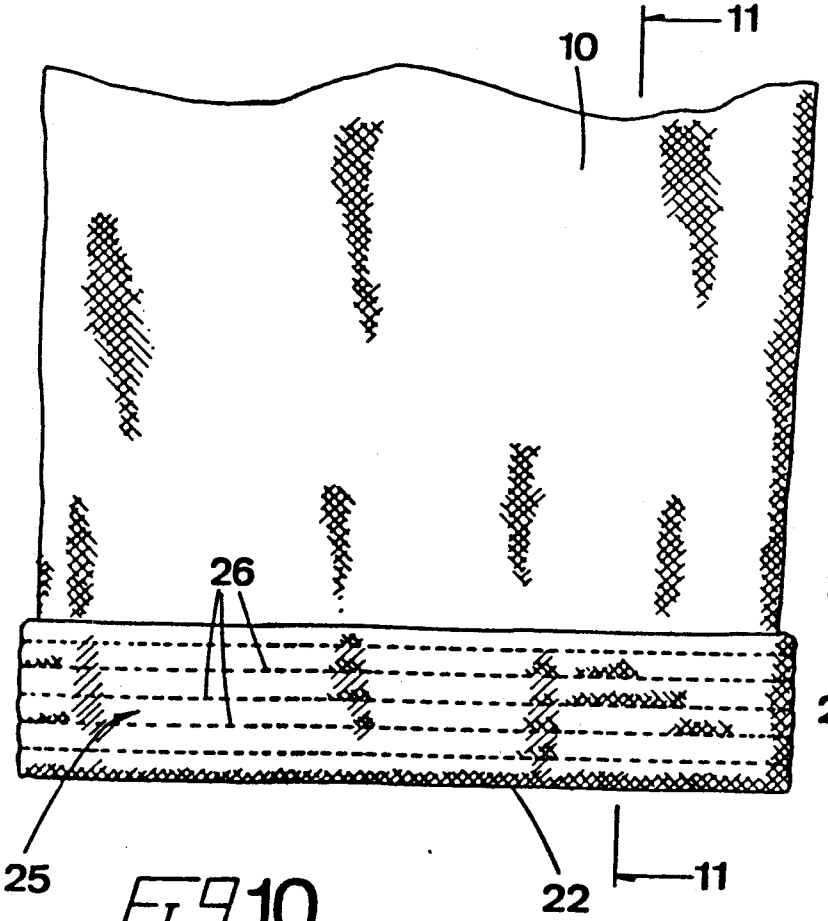
FIG. 10 is an outside view of the cuff arrangement shown in FIG. 7 in the low position.

According to a second embodiment of the present invention shown in FIGS. 7 through 12, a pant leg 10 is provided which is of identical construction to that of the first embodiment described herein above. Once again, a cuff 22 having a tubular construction is attached to the outside leg by a cuffstitch 24 at the base of the cuff 22. However, in this second embodiment of the present invention, VELCRO pads or other removable attachment means are not provided for holding cuff 22 in place to the outside of leg 10. Rather, as illustrated in FIGS. 7 through 9, the cuff 22 is held in place, namely in a position folded upwards away from the high position hemline 14, by means of suitably patterned stitching 25 applied to the cuff. Such stitching or quilting 25, for instance in a pattern formed by a plurality of laterally disposed parallel stitches 26 extending circumferentially around the cuff strip, act to stiffen the cuff to thereby retain it in the high position shown in FIGS. 7 through 9. Other suitable pattern stitching for stiffening the cuff strip may also include that formed by two intersecting sets of obliquely disposed parallel line stitches, in such manner that a diamond pattern is formed on the cuff strip. Preferably, nylon thread may be used for the purpose of applying the aforesaid patterned stitching to the cuff strip.

Although patterned stitching has been illustrated herein as a means of stiffening the cuff strip 22, those skilled in this art will appreciate that other stiffening means may be provided for the cuff, such as employing a heavy grade fabric therefor or alternatively, by providing a rigid insert circumferentially disposed therein.

Various changes may be made to the embodiments described herein without departing from the scope of the present invention which is limited only by the following claims.

I claim:

1. A drop down cuff arrangement for a pant leg, or sleeve comprising:

a pant leg or sleeve having an un-extended position wherein a first portion of the leg or sleeve includes a finished hem at the end to form an un-extended position hemline, a cuff strip stitched to the outside of the leg or sleeve above the un-extended position hemline, folded upwards away from the un-extended position hemline, said cuff strip being held in place by stiffening means therefor, the pant leg or sleeve having an extended position wherein the cuff strip is folded down over the un-extended position hemline.

2. The drop down cuff arrangement according to claim 1, wherein said stiffening means for the cuff strip consists of patterned stitching being applied thereon to thereby stiffen said strip.

3. The drop down cuff arrangement according to claim 2, wherein the said patterned stitching is formed by a plurality of laterally disposed parallel line stitches extending circumferentially around the cuff strip.

* * * * *